US009462865B2

(12) United States Patent
Takayama et al.

(10) Patent No.: US 9,462,865 B2
(45) Date of Patent: Oct. 11, 2016

(54) FOLDABLE ELECTRONIC DEVICE CASE

(71) Applicant: Logitech Europe S.A, Lausanne (CH)

(72) Inventors: Steven Ryutaro Takayama, Atherton, CA (US); Branko Lukic, Menlo Park, CA (US); Bach Nguyen, San Francisco, CA (US); Denis O'Keeffe, Newmarket (IE); Kevin McLintock, San Mateo, CA (US); Andreas Oliver Connellan, Cork (IE)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 14/686,718

(22) Filed: Apr. 14, 2015

(65) Prior Publication Data

US 2016/0106189 A1 Apr. 21, 2016

Related U.S. Application Data

(60) Provisional application No. 62/064,393, filed on Oct. 15, 2014.

(51) Int. Cl.
*B65D 85/00* (2006.01)
*A45C 11/00* (2006.01)

(52) U.S. Cl.
CPC ..... *A45C 11/00* (2013.01); *A45C 2011/003* (2013.01)

(58) Field of Classification Search
CPC ..... G01F 1/1628; A45C 2013/025; A45C 11/00; A45C 2011/002; A45C 2011/003
USPC ..... 206/320, 724, 521, 316.1, 316.2, 721; 229/68.1, 87.01, 87.02
See application file for complete search history.

(56) References Cited

U.S. PATENT DOCUMENTS

| | | | | |
|---|---|---|---|---|
| 1,787,793 | A * | 1/1931 | Noble | A45C 11/38 206/316.2 |
| 8,286,789 | B2 * | 10/2012 | Wilson | A45C 11/00 206/320 |
| 8,718,731 | B1 * | 5/2014 | Tang | H04M 1/185 206/305 |
| 8,757,385 | B2 * | 6/2014 | Goel | B65D 5/4295 206/320 |
| 2003/0029767 | A1 * | 2/2003 | Collins | B65D 81/03 206/521 |
| 2004/0188289 | A1 * | 9/2004 | Woo | A45C 13/02 206/320 |
| 2006/0081489 | A1 * | 4/2006 | Wheeler | G06F 1/1628 206/320 |
| 2008/0121541 | A1 * | 5/2008 | Clark | H01H 9/0242 206/320 |
| 2012/0080156 | A1 * | 4/2012 | Laleg | D21H 11/18 162/158 |
| 2013/0098789 | A1 * | 4/2013 | Jun | B65D 5/5213 206/320 |
| 2015/0282648 | A1 * | 10/2015 | Zaccardo | B65D 5/301 206/561 |
| 2015/0284141 | A1 * | 10/2015 | Ni | B32B 15/08 428/34.3 |

OTHER PUBLICATIONS iPhone 4 Paper Case Turorial. Posted Jul. 8, 2010. http://www.tuesday.com/blog/labs/2010/07/08/iphone-4-apaper-case-tutorial/.

* cited by examiner

*Primary Examiner* — Jacob K Ackun
*Assistant Examiner* — Rafael Ortiz
(74) *Attorney, Agent, or Firm* — Patterson & Sheridan, LLP

(57) ABSTRACT

Embodiments of the disclosure may provide a low cost customizable case for electronic devices. The low cost customizable case may have a preassembled form and a post assembled form. In the preassembled form, the low cost customizable case may be planar and include a first plurality of regions and a second plurality of regions. A plurality of protrusions may be formed on the first plurality of regions.

24 Claims, 13 Drawing Sheets

FOLDABLE ELECTRONIC DEVICE CASE

CROSS-REFERENCE TO RELATED APPLICATIONS

This application claims benefit of U.S. provisional patent application Ser. No. 62/064,393, filed Oct. 15, 2014, which is hereby incorporated herein by reference.

BACKGROUND

1. Field

Embodiments disclosed herein generally relate to protective covers used on an electronic device, and more specifically to a low cost customizable case for an electronic device.

2. Description of the Related Art

The popularity of portable electronic devices, such as smart phones, touch pads, PDAs, portable computers and portable music players, has increased dramatically in the past decade. As people have become more reliant on portable electronic devices they have found more and more uses in the home, business and automobiles. However, the price of most portable electronic devices remains high due to the manufacturing cost and demand for these often complex devices. It is therefore important to find ways to protect these devices so that the chances that they will become damaged in normal use is minimized, since the replacement cost of these devices can be many hundreds of dollars.

Typically, most users today protect their portable electronic devices, such as smart phones, with a cover. Conventionally, the cover is a previously made case that can be attached to the electronic device via various methods. The previously made case is typically made of a plastic material, such as polymer or rubber. Typically, these covers tend to be expensive and have very industrial oriented graphic and/or physical designs that are already formed in the plastic cover. Due to their manufacturing process and selected materials it is nearly impossible to customize the graphic and/or physical designs of most conventional cases to meet one's taste. The cost of most conventional electronic device cases are relatively high, such as greater than $30 per case, making it cost prohibitive to have more than one case or to replace the case when it becomes cosmetically damaged or the user simply becomes tired of its ornamental design.

Therefore, there is a need for an improved low cost customizable case for an electronic device that solves the problems described above.

SUMMARY

Embodiments of the disclosure may provide a low cost customizable case for electronic devices. The low cost customizable case may have a preassembled form and a post-assembled form. In the preassembled form, the low cost customizable case may be planar and include a first plurality of regions and a second plurality of regions. A plurality of protrusions may be formed on the first plurality of regions.

In one embodiment, a case for an electronic device is disclosed. The case includes a template having a first plurality of regions and second plurality of regions. The template is planar and a plurality of fold lines are formed on the template. The template is configured to be folded along the fold lines to form the case covering multiple sides of the electronic device. The case further includes a plurality of protrusions disposed on the first plurality of regions, wherein the protrusions are configured to be disposed between a portion of the template and the electronic device when the case is positioned to cover the multiple sides of the electronic device.

In another embodiment, a kit for forming a case for an electronic device is disclosed. The kit includes a planar medium, and the planar medium includes a first surface and a second surface opposite the first surface. A template is formed on the first surface and the second surface of the planar medium. A plurality of fold lines are formed on the planar medium within the template, and the template is configured to be detached from the planar medium and folded along the fold lines to form the case covering multiple sides of the electronic device. The kit further includes a plurality of protrusions that are separate from the planar medium.

In another embodiment, a method for forming a case for an electronic device is disclosed. The method includes forming a template on a first surface and a second surface of a planar medium. The template includes a plurality of fold lines. The method further includes forming graphic designs on the first surface or the second surface of the planar medium within the template, forming a plurality of openings in the planar medium within the template, disposing a plurality of protrusions on the first surface or the second surface of the planar medium within the template, separating the template from the planar medium, and folding the template along the fold lines so that the protrusions are disposed between a portion of the template and the electronic device when the case is positioned to cover at least a portion of the electronic device.

In another embodiment, a case for covering multiple sides of an electronic device is disclosed. The case includes a planar medium having a first plurality of regions configured to be separated from the planar medium to form a plurality of holes in the planar medium, and a second plurality of regions configured to form a plurality of protrusions on the planar medium.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figures 1A, 1B, 1C, 1D, 1E:
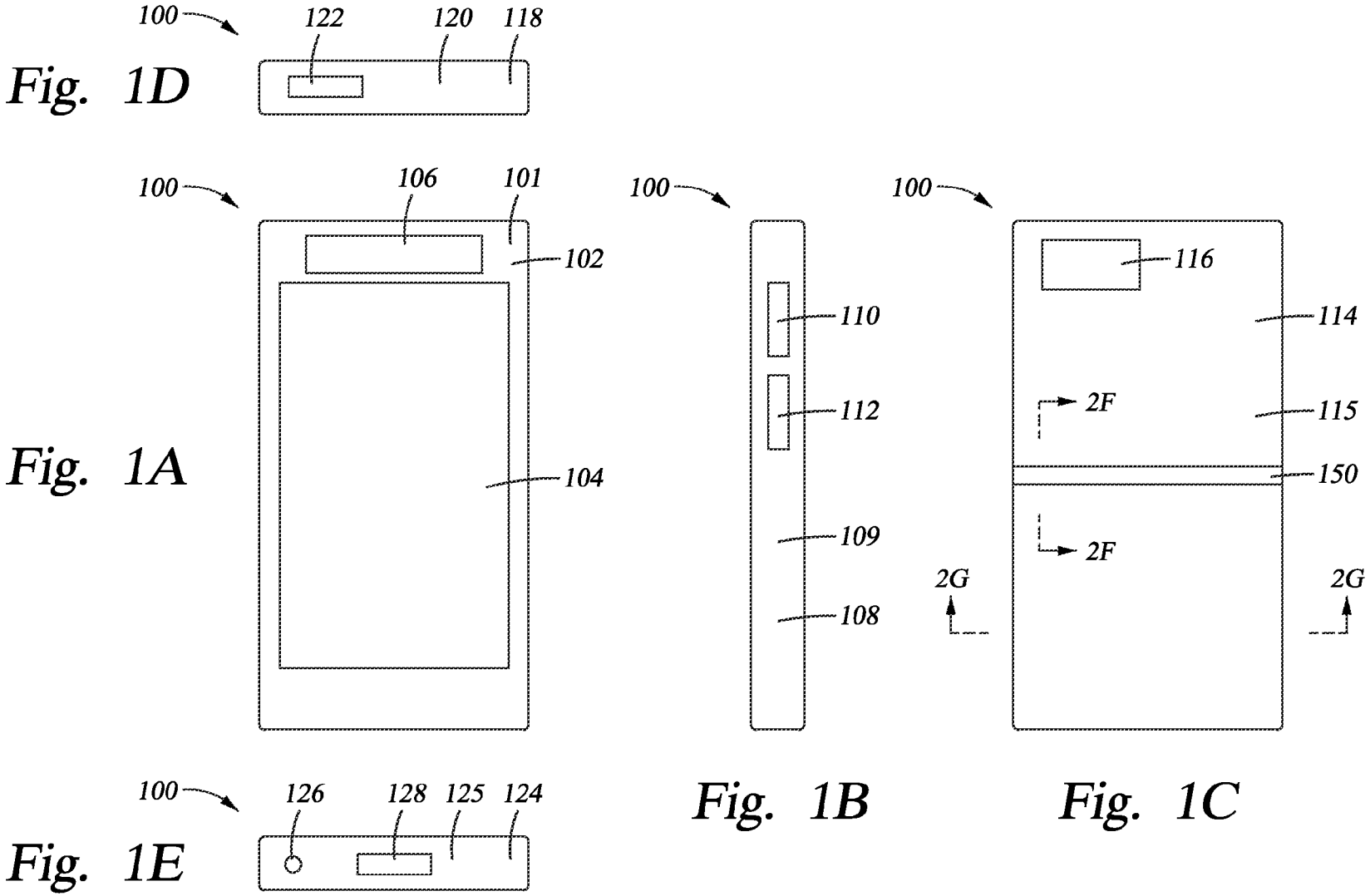
FIGS. 1A-1E are conceptual diagrams that illustrate a case in post assembled form according to embodiments of the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Embodiments of the disclosure may provide a low cost customizable case for electronic devices. The low cost customizable case may have a preassembled form and a post assembled form. In the preassembled form, the low cost customizable case may be planar and include a first plurality of regions and a second plurality of regions that can be adapted to cover desired portions of the case. A plurality of protrusions that are used to form ornamental features and/or provide some damage protection to the covered electronic device during normal use may be formed on the first plurality of regions.

FIGS. 1A-1E are conceptual diagrams that illustrate a case 100 in post assembled form according to embodiments of the present disclosure. FIG. 1A is a front view of the case 100 in post assembled form. The case 100 may include a front cover 101 having a first surface 102. The front cover 101 may include an opening 106 for exposing a portion of the electronic device placed inside the case 100. In one embodiment, the electronic device is a mobile phone and the portion exposed by the opening 106 is a speaker and/or a front-facing camera. The front cover 101 may include another opening 104 for exposing another portion of the electronic device placed inside the case 100. In one embodiment, the electronic device is a mobile phone and the portion exposed by the opening 104 is a touch screen. A transparent material may cover the opening 104 to prevent dust and liquids from getting on the touch screen of the mobile phone. Additional openings may be formed in the front cover 101 to expose portions of the electronic device placed in the case 100. The first surface 102 of the front cover 101 may have graphic and/or physical designs formed thereon, that are formed by printing (e.g., inkjet printing, laser printing), etching, rubber stamping, cutting, abrading, embossing or other similar technique. Alternatively, the first surface 102 of the front cover 101 may not have any graphic and/or physical designs, and a user may separately customize the case 100 by forming graphic designs and/or physical designs on the first surface 102 of the front cover 101 by printing, etching, rubber stamping, cutting, abrading, embossing or other similar technique.

FIG. 1B is a side view of the case 100 in post assembled form. The case 100 may include two side covers 108 (only one is shown), and each side cover 108 has a first surface 109. One or more openings 110, 112 may be formed in one or more side covers 108 depending on the electronic device placed in the case 100. In one embodiment, the electronic device placed in the case 100 is a mobile phone, and the openings 110, 112 are formed in one side cover 108 to expose a silent switch and volume controls, respectively. The other side cover (not shown) may also include openings to expose other portions of the electronic device, such as a power switch. Additional openings may be formed in the side covers 108 to expose portions of the electronic device placed in the case 100. The first surface 109 of the side covers 108 may have graphic and/or physical designs formed thereon. Alternatively, the first surface 109 of the side covers 108 may not have any graphic and/or physical designs, and a user may customize the case 100 by printing or drawing graphic designs and/or forming physical designs on the first surface 109 of the side covers 108.

FIG. 1C is a back view of the case 100 in post assembled form. The case 100 may include a back cover 114 having a first surface 115. The back cover 114 may include one or more openings 116 for exposing one or more portions of the electronic device placed in the case 100. In one embodiment, the electronic device placed in the case 100 is a mobile phone, and the opening 116 is formed to expose a camera lens. One or more impact channels 150 may be formed in the first surface 115 of the back cover 114. The one or more impact channels 150 are described in detail below. Additional openings may be formed in the back cover 114 to expose portions of the electronic device placed in the case 100. The first surface 115 of the back cover 114 may have graphic and/or physical designs formed thereon. Alternatively, the first surface 115 of the back cover 114 may not have any graphic and/or physical designs, and a user may customize the case 100 by printing or drawing graphic designs and/or forming physical designs on the first surface 115 of the back cover 114.

FIG. 1D is a top side view of the case 100 in post assembled form. The case 100 may include a top cover 118 having a first surface 120. The top cover 118 may include one or more openings 122 for exposing one or more portions of the electronic device placed in the case 100. In one embodiment, the electronic device placed in the case 100 is a mobile phone, and the opening 122 is formed to expose a power switch. Additional openings may be formed in the top cover 118 to expose portions of the electronic device placed in the case 100. The first surface 120 of the top cover 118 may have graphic and/or physical designs formed thereon. Alternatively, the first surface 120 of the top cover 118 may not have any graphic and/or physical designs, and a user may customize the case 100 by printing or drawing graphic designs and/or forming physical designs on the first surface 120 of the top cover 118.

FIG. 1E is a bottom side view of the case 100 in post assembled form. The case 100 may include a bottom cover 124 having a first surface 125. The bottom cover 124 may include one or more openings 126, 128 for exposing one or more portions of the electronic device placed in the case 100. In one embodiment, the electronic device placed in the case 100 is a mobile phone, and the opening 126 is formed to expose a headset jack and opening 128 is formed to expose a loud speaker within the mobile phone and/or a device connector. Additional openings may be formed in the bottom cover 124 to expose portions of the electronic device placed in the case 100. The first surface 125 of the bottom cover 124 may have graphic and/or physical designs formed thereon. Alternatively, the first surface 125 of the bottom cover 124 may not have any graphic and/or physical designs, and a user may customize the case 100 by printing or drawing graphic designs and/or forming physical designs on the first surface 125 of the bottom cover 124.

Figure 2A:
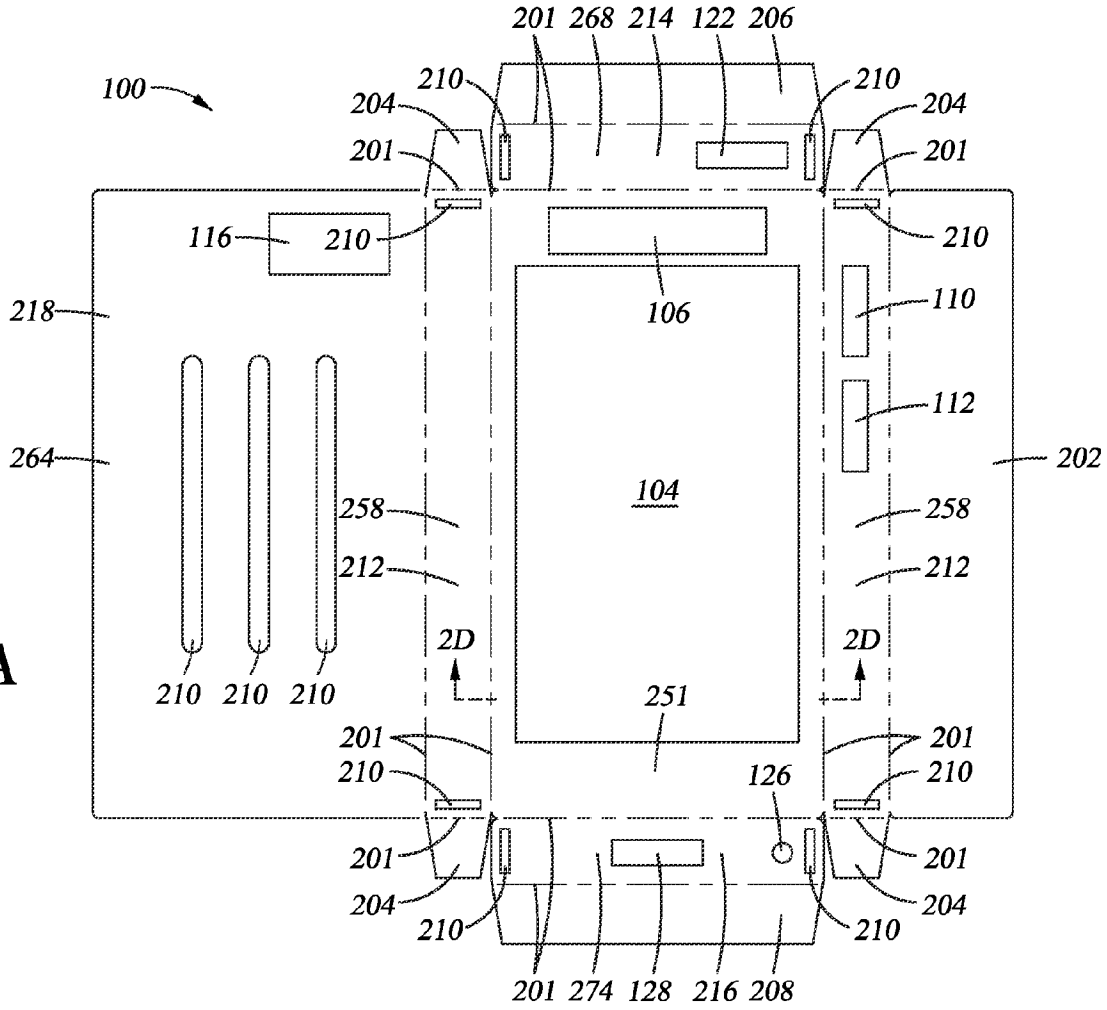
FIGS. 2A-2H are conceptual diagrams that illustrate a case in preassembled form according to embodiments of the present disclosure.

FIGS. 2A-2H are conceptual diagrams that illustrate the case 100 in preassembled form according to embodiments of the present disclosure. As shown in FIG. 2A, the case 100 in preassembled form may include a front cover region 251, a back cover region 264, side cover regions 258, a top cover region 268 and a bottom cover region 274 that are used to eventually form the front cover 101, the back cover 114, the side covers 108, the top cover 118 and the bottom cover 124, respectfully, illustrated in FIGS. 1A-1E above. The openings 104, 106 may be formed in the front cover region 251, the one or more openings 116 may be formed in the back cover region 264, the one or more openings 122 may be formed in the top cover region 268, the openings 110, 112 may be formed in the side cover regions 258, and the openings 126, 128 may be formed in the bottom cover region 274. The back cover region 264, the side cover regions 258 and the front cover region 251 may be connected, and the top cover region 268 and the bottom cover region 274 may also be connected with the front cover region 251 or the back cover region 264. An adhesion region 202 may be connected to the side cover region 258 and may be configured to be adhered to the back cover region 264 when it is positioned in the post assembled form. Flaps 204 may be connected to the side cover regions 258 and may be configured to cover portions of a top side surface and bottom side surface of the electronic device placed in the case 100. Flaps 206, 208 may be coupled to the top cover region 268 and bottom cover region 274, respectively, for securing the top cover region 268 and bottom cover region 274 when the case 100 is positioned in the post assembled form.

To form the case 100 in post assembled form, a user can detach the case 100, which is in a preassembled form, from a planar medium, fold the case 100 in the preassembled form along the fold lines 201, adhere the adhesion region 202 to the back cover region 264 by any suitable adhesion method, and place flaps 206, 208 between the back cover region 264 and the front cover region 251, as further described below. In some configurations, the adhesion region 202 may be attached to the back cover region 264 by methods other than adhesion, such as the method that is described in conjunction with the detail illustrated in FIG. 2H.

When the case 100 is in its preassembled form, the front cover region 251, the back cover region 264, the side cover regions 258, the top cover region 268, the bottom cover region 274, the flaps 204, 206, 208 and the adhesion region 202 may start from a coplanar orientation. A first plurality of regions may include the back cover region 264, the side cover regions 258, the top cover region 268 and the bottom cover region 274, and a second plurality of regions may include the remaining covers and flaps. In one embodiment, the openings 104, 106, 110, 112, 116, 122, 126, 128 are already formed in the planar medium when it is in the coplanar orientation. In other embodiments, the openings 104, 106, 110, 112, 116, 122, 126, 128 are formed in the planar medium during one or more stages of the assembly process. In some cases, the planar medium may have partially formed shapes that are used to form one or more of the openings in the planar medium. The partially formed shapes include connections formed with other regions of the planar medium, where the connections form at least a part of the outer edges of the partially formed shape. The connections may include a fold line or one or more perforations that allow the openings to be easily formed and/or removed from the other regions of the planar medium. In one embodiment, the planar medium includes multiple layers of a material, such as two or more layers of stone paper, to increase the durability of the case 100.

Figure 2B:
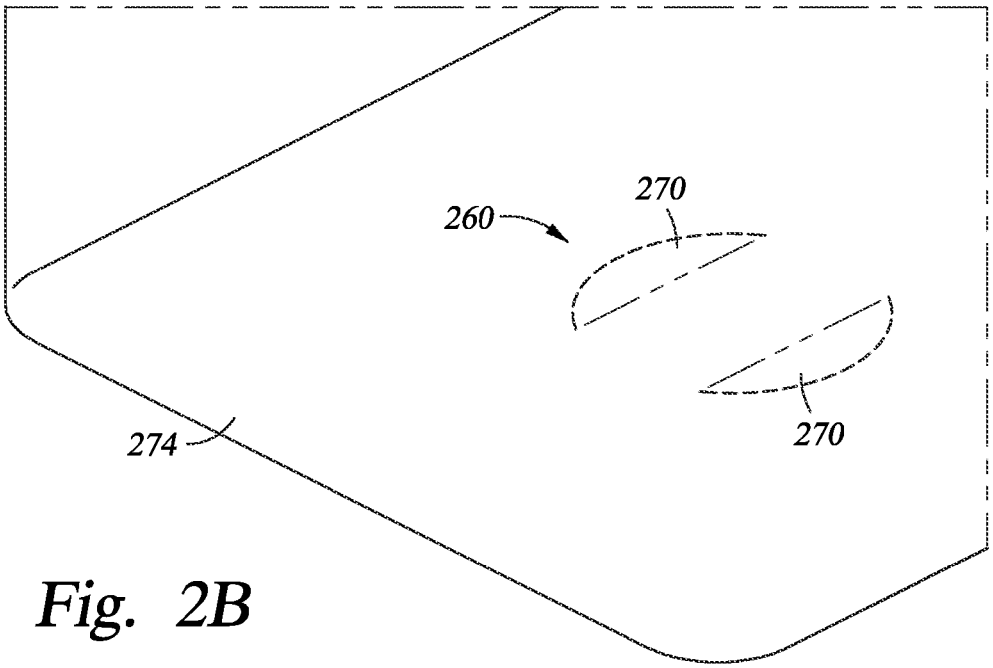
Figure 2C:
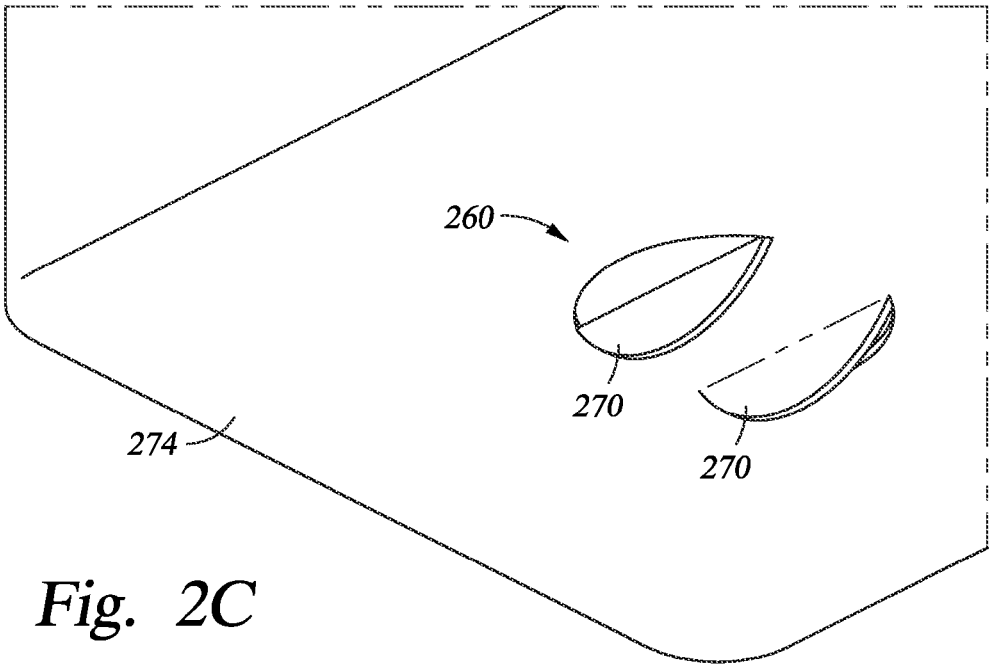

In one embodiment, a partially formed shape may be used to assist in the positioning and aligning of the case 100 in its preassembled form with respect to the electronic device to enable the proper positioning of the post assembled form of the case 100 around the electronic device. In one example, a portion of the partially formed shape is detached from the planar medium and inserted within a feature of the electronic device, so that a remaining connected portion of the partially formed shape can be used to restrain the movement of the planar body relative to the feature of the electronic device. FIGS. 2B and 2C illustrate one example of this configuration. FIG. 2B shows an enlarged view of a portion of the bottom cover region 274. A partially formed shape 260 is formed in the bottom cover region 274 at the location where an opening 126 in the final post assembled form of the case 100 will be. In this example, the partially formed shape 260 has the same shape and size as the final opening 126. The connection of the partially formed shape 260 to the planar medium is partially perforated, as indicated by dotted lines (e.g., fold lines). When covering the electronic device with the case 100, portions 270 of the partially formed shape 260 are separated from the planar medium by breaking the perforated connection to the planar medium. The separated portions are folded to form two tabs 270, as shown in FIG. 2C, and the tabs 270 are then inserted into an opening of the electronic device, such as the headset jack of a mobile phone. The inserted tabs 270 help positioning the case 100 in the preassembled form with respect to the electronic device, so that the case 100 can be correctly positioned and formed around the electronic device by folding the case 100.

Since the case 100 includes a planar medium, such as a piece of stone paper, the electronic device placed in the case 100 may need additional protection to assure that the electronic device will withstand more than normal wear and tear. For example, the electronic device placed in the case 100 can be easily damaged when the electronic device is dropped or bumped. To protect the electronic device placed in the case 100 from an impact, a plurality of protrusions 210 may be formed on a first plurality of regions, which may include a second surface 218 of the back cover region 264, a second surface 212 of the side cover regions 258, a second surface 214 of the top cover region 268 and a second surface 216 of the bottom cover region 274. The plurality of protrusions 210 may be made of a material that can reduce the energy transmitted to an electronic device in an impact created when the case 100 and electronic device are accidentally dropped or bumped. The plurality of protrusions 210 may be made of a polymer, such as silicone, rubber, an elastomer or any other suitable material. The plurality of protrusions 210 may be in any suitable shape or shapes, such as a 2D shape (e.g., disk shaped, rectangular shaped) that has a thickness or a 3D shape (e.g., spherical shaped). In one embodiment, the plurality of protrusions 210 disposed on the side cover regions 258, top cover region 268 and bottom cover region 274 are spherical bumps, and the plurality of protrusions 210 disposed on the back cover region 264 are rectangular shaped bars having a thickness. When the electronic device is placed in the case 100, the plurality of protrusions 210 are in contact with the edges and back of the electronic device. In this configuration, the plurality of protrusions 210 can absorb the impact when the electronic device placed inside the case 100 is dropped or bumped.

Figure 2F:
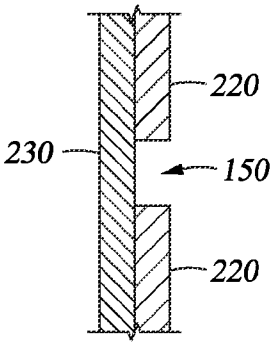
Figure 2D:
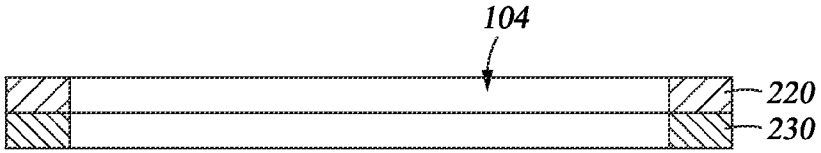

FIG. 2D is a cross sectional view of the case 100 at section line 2D-2D shown in FIG. 2A. In some embodiments, as shown in FIG. 2D, the planar medium of the case 100 may include a multi-layer structure. In one example, the multi-layer structure includes a first layer 220 and a second layer 230. The multi-layer structure of planar medium will generally improve the durability and damage resistance of the case 100. As shown in FIG. 2D, there is no material covering the opening 104.

Figure 2E:
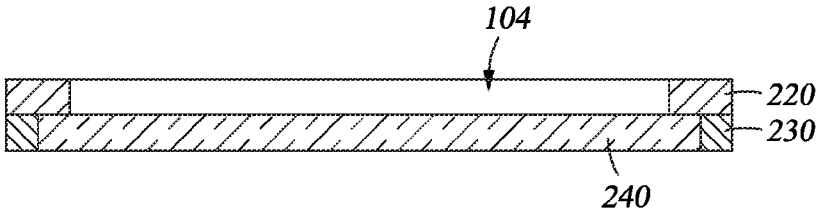

In other embodiments, a transparent material may cover the opening 104 in order to prevent dust and liquid from getting on the exposed portion of the electronic device disposed in the case 100. FIG. 2E is a cross sectional view of the case 100 at section line 2D-2D shown in FIG. 2A according to an embodiment. As shown in FIG. 2E, a transparent layer 240 is formed in the opening 104 to prevent dust and liquid from getting on the exposed portion of the electronic device, such as the touch screen of a mobile phone. The transparent layer 240 may be made of a thin and flexible material that may include acrylic, polyvinyl chloride (PVC), polyethylene (PE), polypropylene (PP) or any suitable transparent material. The transparent layer 240 may be coupled to the layer 220, as shown in FIG. 2E, or the transparent layer 240 may be sandwiched between the layers 220, 230.

The multi-layer structure may also be used to encase and protect the electronic device, while still allowing some slightly muted tactile contact with portions of the electronic device. Thus, in some embodiments, the case 100 may include regions that are formed by removing portions of one or more of the layers of planar medium material in the multi-layer structure (e.g., removing a portion of the first layer 220), to allow improved touch/feel with a user input element on the electronic device, such as a button on the front of the electronic device, while allowing the input element to still remain covered by one or more layers of the planar medium (e.g., second layer 220).

The case 100 may also include one or more impact channels 150 shown in FIG. 1C. FIG. 2F is a cross sectional view of the case 100 at section line 2F-2F shown in FIG. 1C. As illustrated in FIG. 2F, the planar medium includes the layers 220, 230, and one or more impact channels 150 are formed in the layer 220. The one or more impact channels 150 add flexibility to the case 100 while absorbing energy from drops.

Figure 2G:
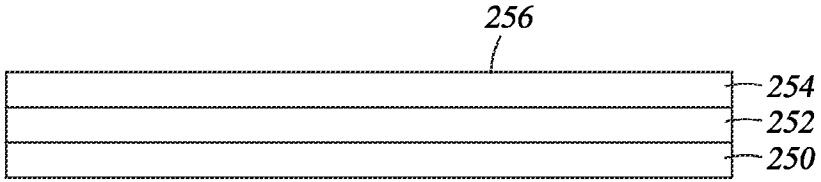

FIG. 2G is a cross sectional view of the case 100 formed using section line 2G-2G shown in FIG. 1C. As shown in FIG. 2G, the case 100 include a first layer 250, a second layer 252, and a third layer 254. The first layer 250 may be adjacent to the electronic device. In some embodiments, the first layer 250 may be made of a shock absorbing material, such as cotton paper, bamboo paper, hemp paper, corkboard, cardboard, stone paper, natural fiber composites, bamboo ply, wood, plywood, plastic, or carbon fiber. In some embodiments, the first layer 250 may be made of a tear resistant material, such as pulp fiber blends (e.g. natural cellulose and non-woven impregnated felt), Tyvek®, Fabric, or recycled plastics. The second layer 252 may be made of the shock absorbing material as mentioned above or the tear resistant material as mentioned above to increase the tensile strength of the case 100. The third layer 254 may be outmost layer of the case 100 and may include a surface 256 that is cosmetically pleasing, printable and/or customizable. The third layer 254 may include materials such as latex coated paper or other types of coated paper. The combination of layers in the multi-layered configuration of the planar medium section shown in FIG. 2G can improve the durability of the cover 100 and improve the shock resistance provided to a covered electronic device by the cover 100, while still providing a desired cosmetically pleasing and customizable configuration. A multi-layered type case 100 that utilizes the first, second and third layers 250, 252, 254 structure combines mechanical and cosmetic properties and functions to deliver advanced performance in a single simple structure.

Figure 2H:
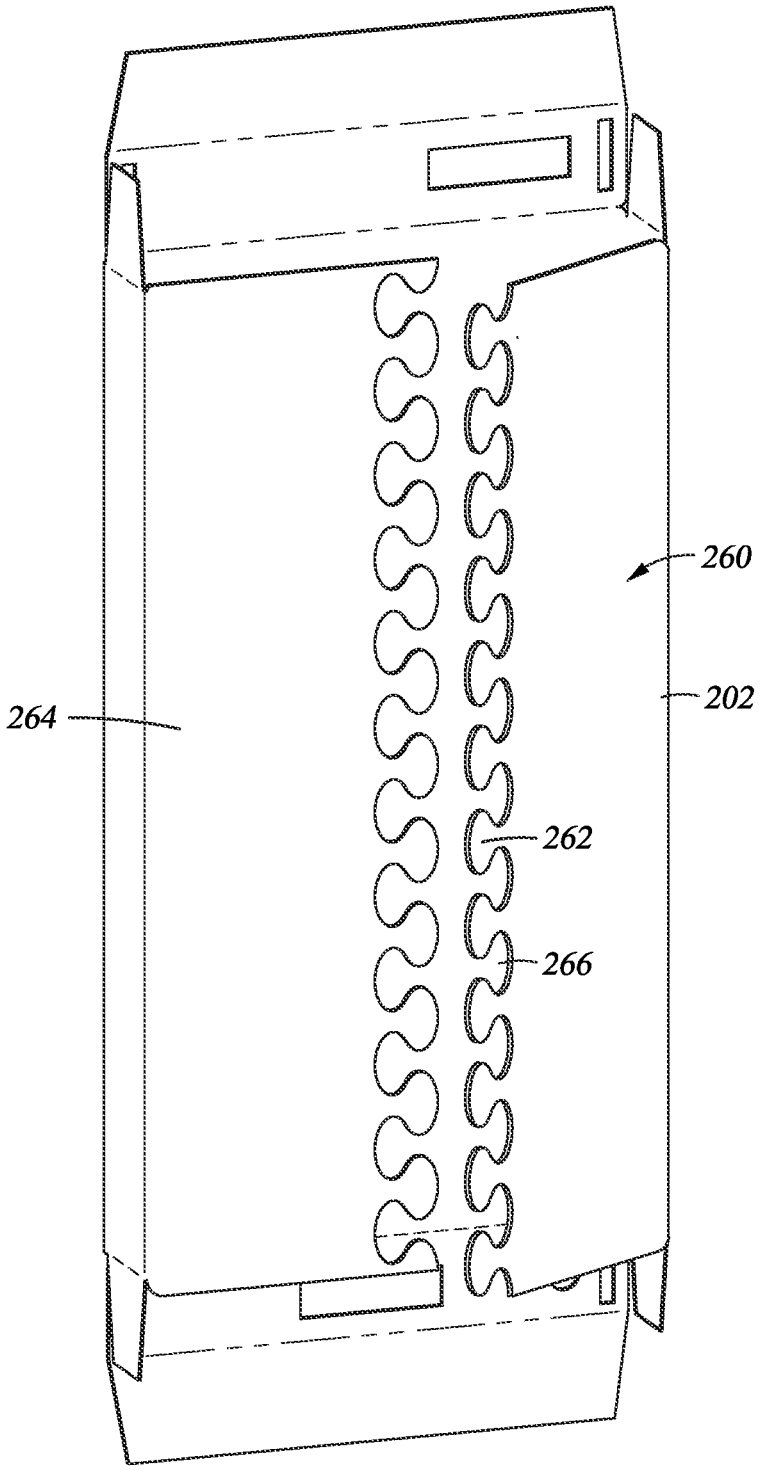

FIG. 2H is a perspective view of the cover 100 that includes an alternate version of the adhesion region 202 and the back cover region 264. Each region 202, 264 may include at least a portion of an interlocking mechanism 260. The portions of the interlocking mechanisms 260 within the regions 202, 264 may be easily interlocked and separated from each other. Each portion of the interlocking mechanism 260 may include a plurality of protrusions 262 and a plurality of recesses 266. Each protrusion 262 of the interlocking mechanism 260 in the adhesion region 202 may be aligned with a corresponding recess 266 of the portion of the interlocking mechanism 260 in the back cover region 264. To attach the adhesion region 202 to the back cover region 264, the protrusions 262 are placed in the recesses 266 from the top, and since the recess 266 has an opening that is equal to or smaller than the size of the protrusion 262, the adhesion region 202 can be securely attached to the back cover region 264. The interlocking mechanisms 260 may be separated by pushing down on one of the regions 202, 264 in order to pop the protrusions 262 out of the recesses 266. The interlocking mechanism 260 may thus provide a reusable method of joining various portions of the cover 100 together. In some cases, various portions of the cover 100 can be reconfigured with other similarly formed parts of the cover, which have a similar mating pattern of protrusions, to allow the cover to be desirably configured and reconfigured. The interlocking mechanism 260 may thus allow the case 100 to be easily configured and reconfigured by attaching, detaching and reattaching the interlocking elements.

Figure 3B:
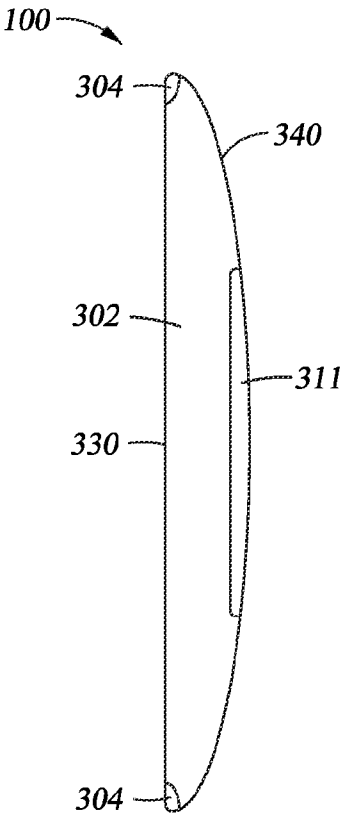
FIGS. 3A-3B are conceptual diagram that illustrate a case in preassembled form according to embodiments of the present disclosure.
Figure 3A:
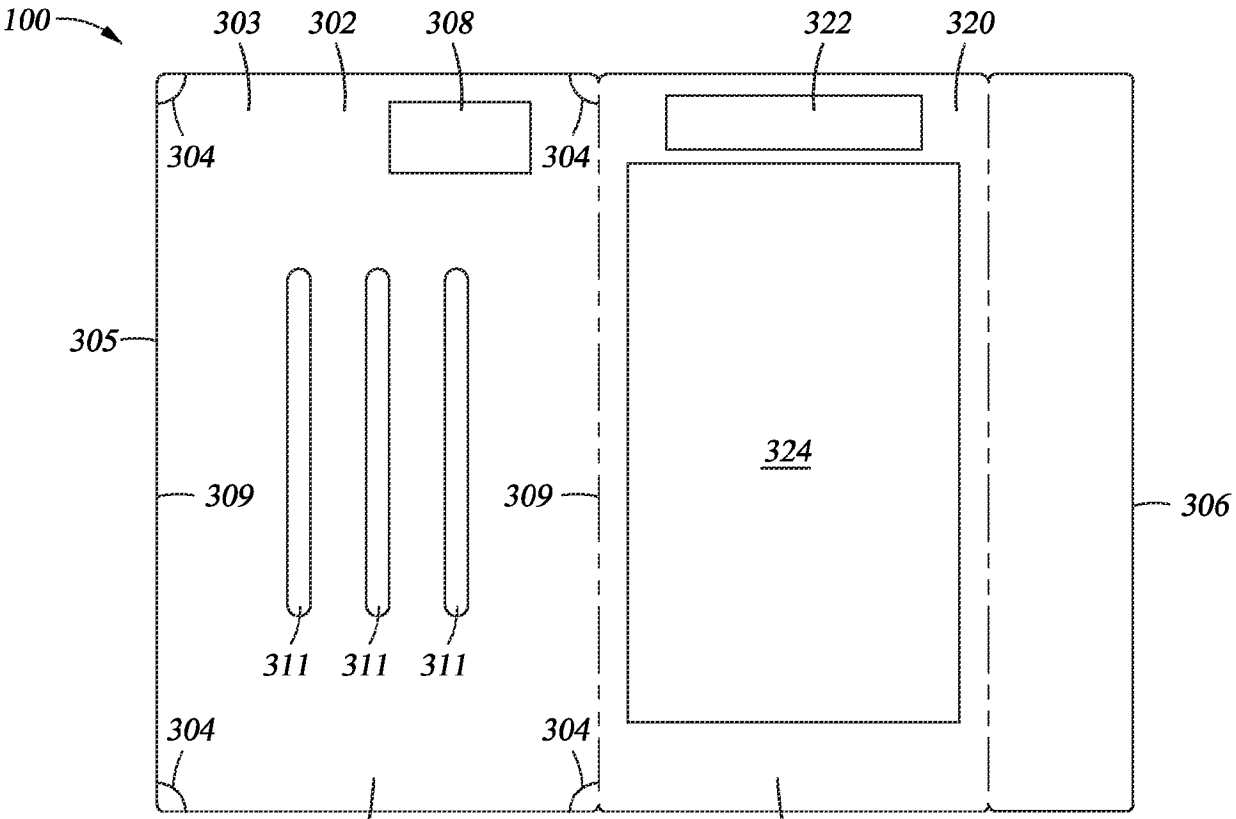

FIGS. 3A-3B are conceptual diagrams that illustrate the case 100 in a preassembled form according to embodiments of the present disclosure. As shown in FIG. 3A, the case 100 in preassembled form may be a planar medium having a first region 310, a second region 312 and an adhesion region 306. The first region 310 may include a front cover region 320 having the openings 322, 324. The front cover region 320 may be used to eventually form the front cover 101 of the case 100 in the post assembled form. The openings 322, 324 may have the same functions as the openings 106, 104, respectively, shown in FIG. 1A. The second region 312 may include a cover region 303. The cover region 303 may be used to eventually form the back cover 114, the side covers 108, the top cover 118 and the bottom cover 124. One or more openings 308 may be formed in the cover region 303, and the opening 308 may have the same functions as the opening 116 shown in FIG. 1C. An adhesion region 306 may be connected to the first region 310. The adhesion region 306 may be configured to be adhered to a side surface 305 of the cover region 303.

In some embodiments, the second region 312 may not be coplanar with the first region 310. Instead, a trough 302 may be formed in the second region 312. In other words, the cover region 303 includes the trough 302. In order to provide an easy way to customize the case 100, the trough 302 may be formed by a user or a retailer who is selling the case 100 in its preassembled form. In configurations that do not contain the trough 302, the first and second regions 310, 312 may be coplanar, which is easy for printing and/or drawing on the first and/or second regions 310, 312. The trough 302 may be formed after printing on the first and second regions 310, 312. A plurality of spherical bumps 304 may be formed in the corners of the trough 302. The bumps 304 may be made of the same material as the plurality of protrusions 210, as shown in FIG. 2A, to help reduce any damage that may occur to the electronic device if it is dropped. One or more bars 311 may be formed on the cover region 303, and the one or more bars 311 may be made of the same material as the plurality of protrusions 210, as shown in FIG. 2A. The electronic device, such as a mobile phone, may be placed in the trough 302 with the back side of the electronic device being adjacent the cover region 303. In some embodiments, the plurality of bumps 304 and the one or more bars 311 may be in contact with the electronic device, while the cover region 303 is not in contact with the electronic device. The side surface 305 of the cover region 303 and the adhesion region 306 may be adhered together by folding along the line 309 and using any suitable adhesion method. FIG. 3B is a cross sectional side view of the case 100 in the post assembled form. As shown in FIG. 3B, the case 100 includes a front cover 330 and a cover 340. The front cover 330 may be the front cover region 320 shown in FIG. 3A and the cover 340 may be the cover region 303 shown in FIG. 3A. The plurality of bumps 304 and the one or more bars 311 are formed on the cover 340 for protecting the electronic device placed in the case 100. The electronic device, such as a mobile phone, may be placed in the trough 302, and in contact with the bumps 304 and bars 311, while not in contact with the cover 340. The plurality of bumps 304 and the one or more bars 311 are made of a shock absorbent material to absorb the impact energy when the electronic device is dropped.

Figure 4A:
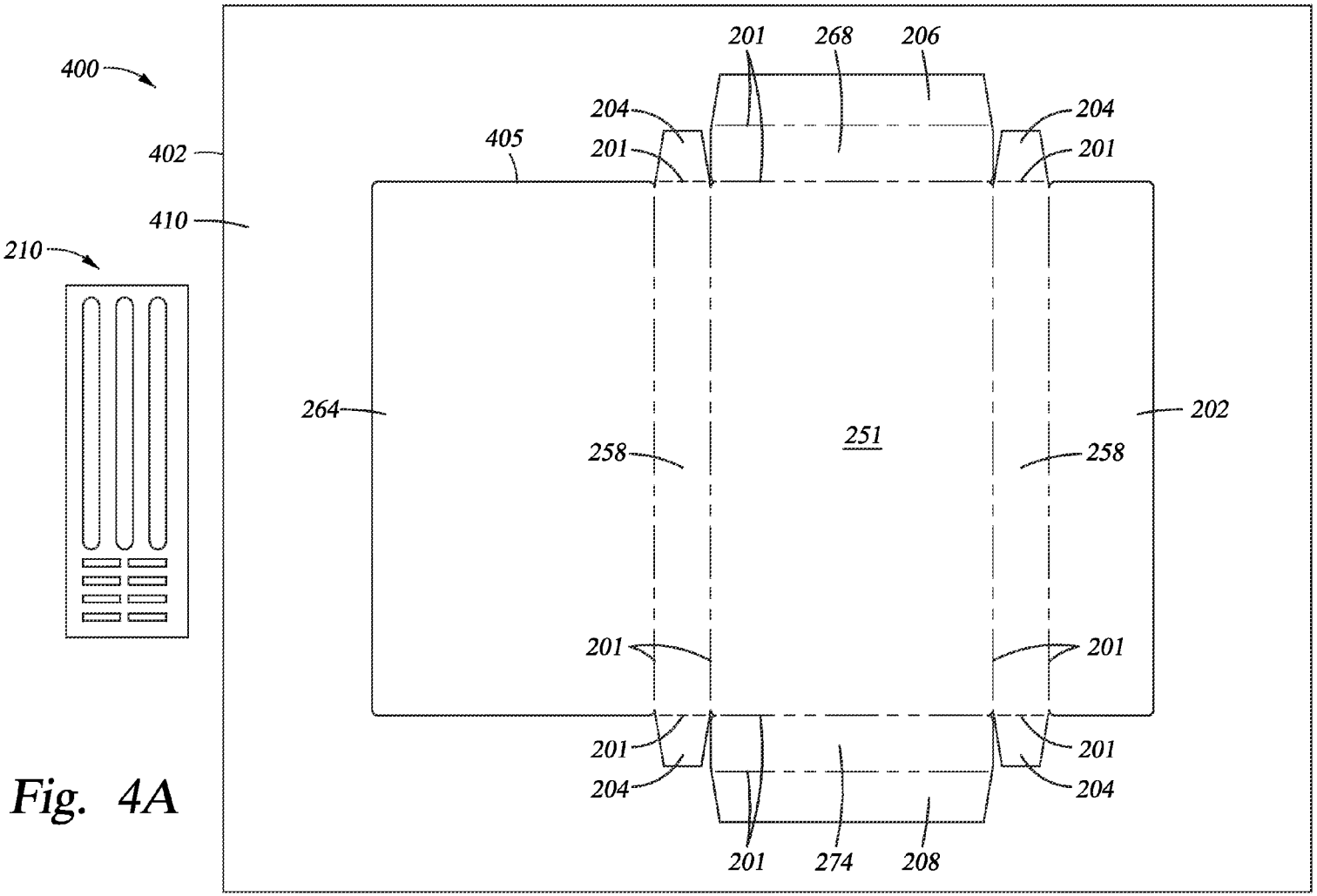
FIGS. 4A-4H illustrate a case in various stages of assembly between a preassembled form and a post assembled form according to embodiments of the present disclosure.

FIGS. 4A-4F illustrate the case 100 as it is transformed from its preassembled form to its post assembled form. A kit 400 for forming the case 100 is shown in FIG. 4A. The kit 400 may include a planar medium 402 and the plurality of protrusions 210 that are separate from the planar medium 402. The planar medium 402 may be a piece of paper, a piece of stone paper, a multi-layer stone paper structure, or any other suitable planar medium. A template 404 of the case 100 in the preassembled form may be formed on a first surface 410 of the planar medium 402. The template 404 may be formed on a second surface 420 (shown in FIG. 4B) of the planar medium 402 that is opposite to the first surface 410. The template 404 may include the border 405 and the fold lines 201. The front cover region 251, the back cover region 264, the side cover regions 258, the top cover region 268, the bottom cover region 274, and the flaps 204, 206, 208 may be included in the template 404. The template 404 may be already drawn on the planar medium 402, and a user may purchase the kit 400 with the planar medium 402 showing the template 404 of a particular electronic device. Alternatively, the kit 400 may include a blank planar medium 402 and the user or a retailer can use software to form the template 404 of a desired electronic device on the blank planar medium 402. The software may come with the kit 400 (e.g., CD ROM) or may be downloaded from the internet using information provided in the kit 400. The provided software may also include instructions that describe the processes of forming the post assembled form of the case 100.

Figure 4B:
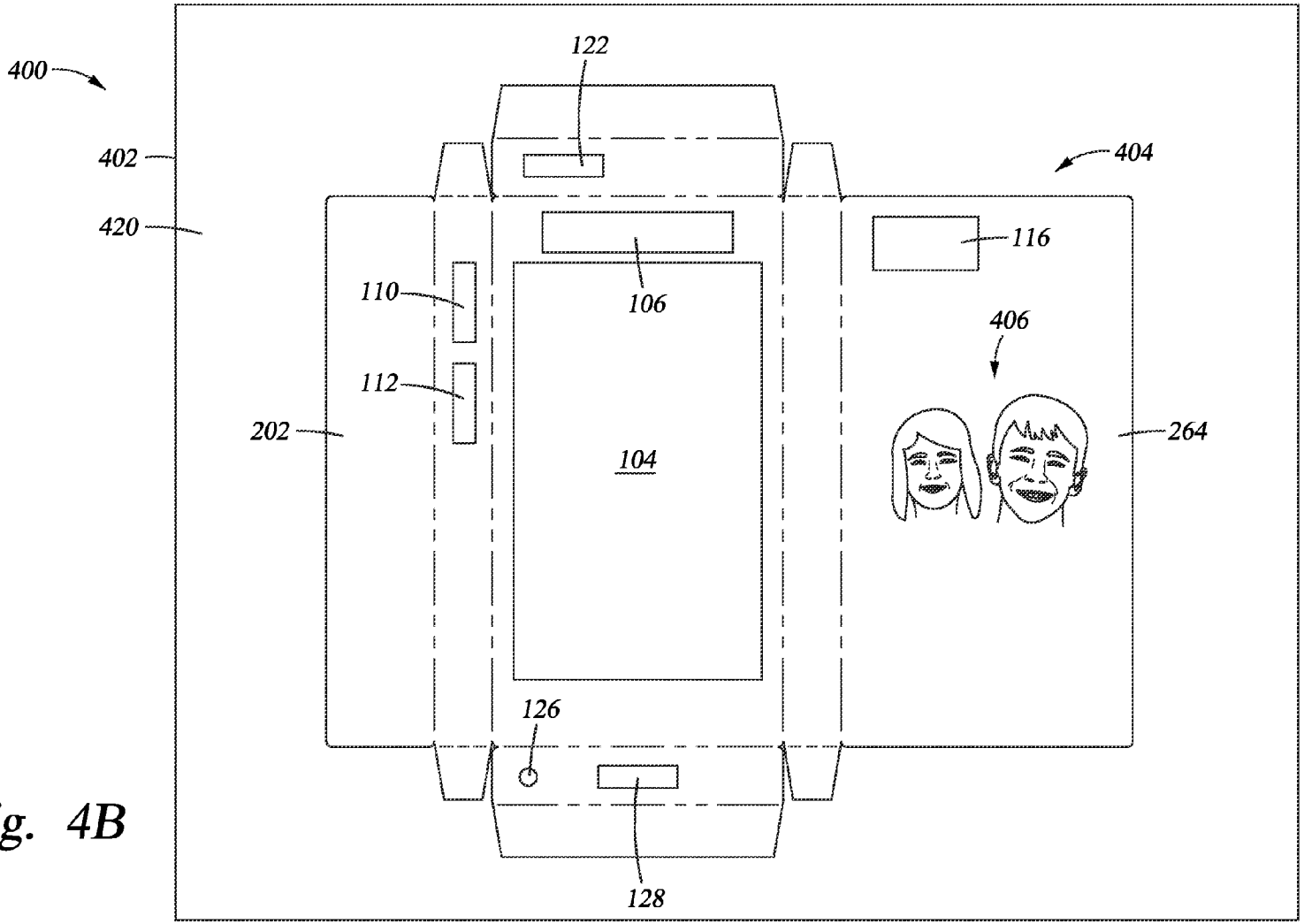

Next, the template 404 may be customized as shown in FIG. 4B. The customization of the template 404 may include forming the openings 104, 106, 110, 112, 116, 122, 126, 128 and forming graphic designs 406 by printing (e.g., inkjet printing), etching, rubber stamping, cutting, abrading, embossing or other similar technique on the planar medium 402 within the template 404. In some embodiments, the graphic designs 406 desirably are disposed on the planar medium 402, including areas outside of the template 404. The graphic designs 406 may be formed on the planar medium 402 in a way that the pattern or design of the graphic designs 406 is aligned when it is configured in its post assembled form, while the graphic designs 406 appear to be fragmented when found in their planar medium 402 form. In some embodiments, the openings are formed before the formation of the graphic designs. In other embodiments, the graphic designs are formed before the formation of the openings. In some embodiments, the openings are pre-formed in the planar medium 402. The user or the retailer can use the provided software to form anything the user desires on one or more specific regions of the template 404. In one example, because the template 404 is on the planar medium 402, the forming can be achieved by feeding the planar medium 402 into a conventional printer, such as an inkjet printer. In one example, after the graphic designs have been formed on the template 404, the trough 302, as shown in FIG. 3B, may be formed by any suitable method.

Figure 4C:
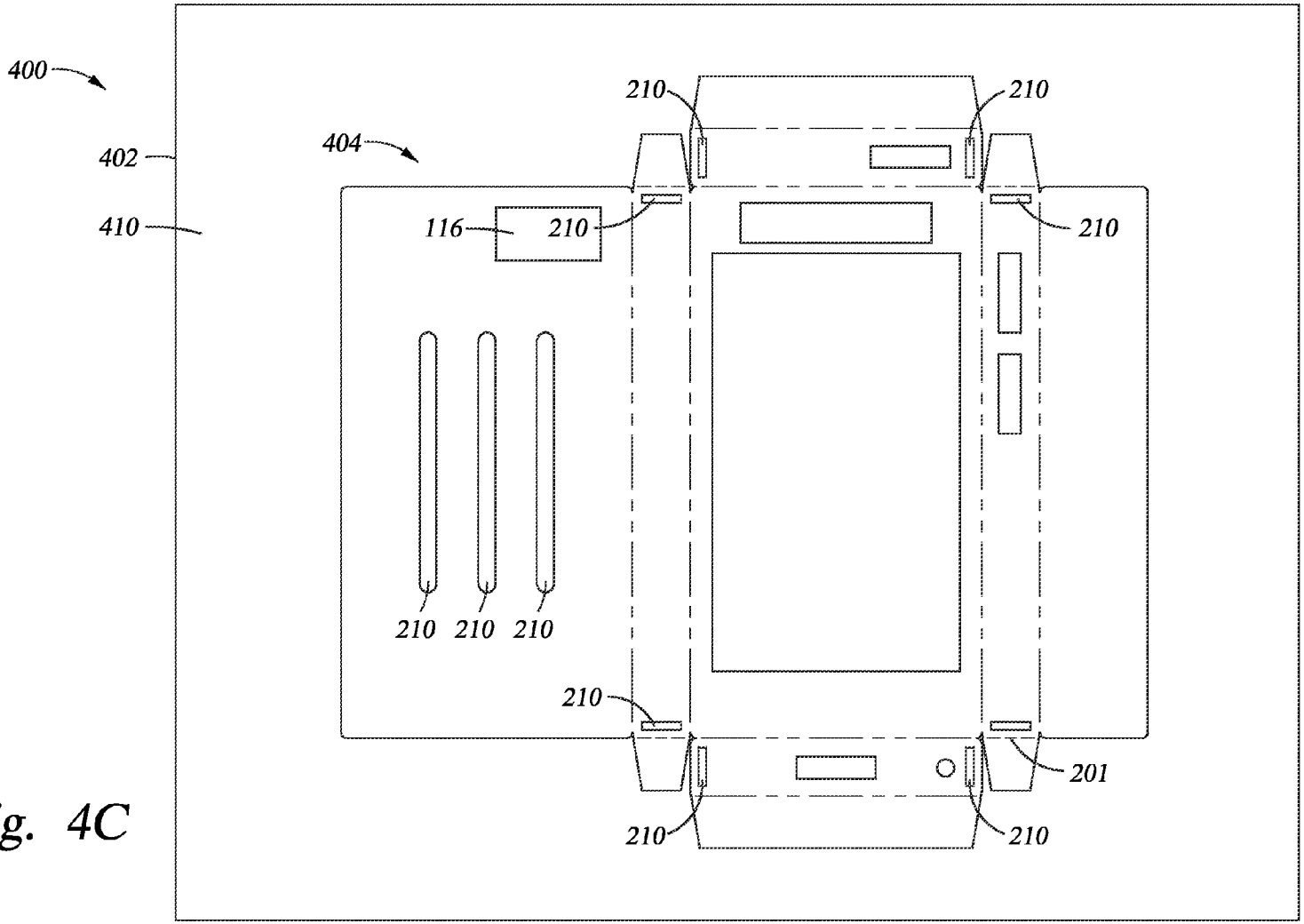

The graphic designs may be formed on the second surface 420 of the planar medium 402 within the template 404, such as on a region of the template 404 that represents the outside of the case 100 in the post assembled form. The plurality of protrusions 210 may be affixed to the first surface 410 that is opposite the first surface 410 of the planar medium 402 within the template 404, such as on a region of the template 404 that represents the inside of the case 100 in the post assembled form, as shown in FIG. 4C. In some embodiments, the process of affixing the protrusions 210 to the first surface 410 may include forming the protrusions on the first surface 410 by use of a deposition process (e.g., ink jet printing, contact printing, jetting or simply dispensing a precursor that forms the protrusions) or bonding a pre-set material used to form the protrusion 210 to the first surface 410 using an adhesive (e.g., PSA).

Figure 4E:
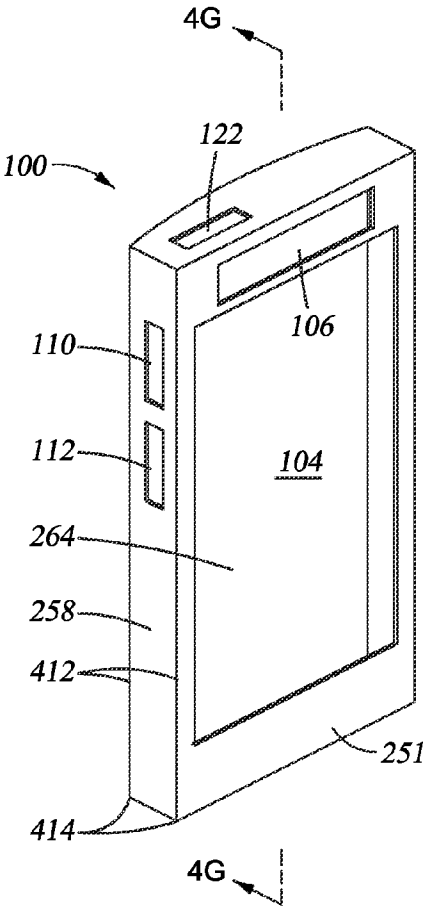
Figure 4D:
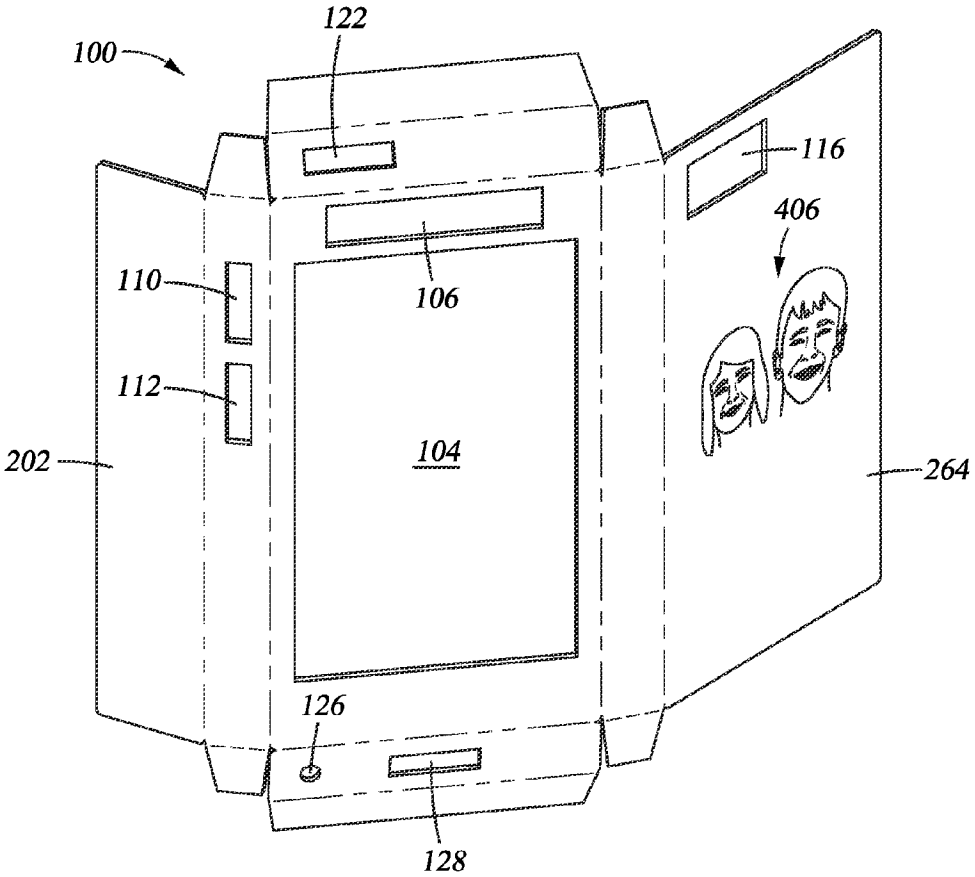

Next, the template 404 having the openings, the graphic designs, and the plurality of protrusions 210 is detached from the planar medium 402 and folded along the fold lines 201, as shown in FIG. 4D. Lastly, the adhesion region 202 is adhered to the back cover region 264 and the flaps 206, 208 are folded between the front cover region 251 and the back cover region 274 to form the case 100 in the post assembled form, as shown in FIG. 4E. The case 100 in post assembled form include the openings 104, 106, 110, 112, 122 for exposing portions of the electronic device placed in the case 100 in the post assembled form.

As shown in FIG. 4E, the side cover regions 258 may form rigid edges 412 with the front cover region 251 and the back cover region 264 in the post assembled form. Additionally, corners 414 of the case 100 in the post assembled form may be sharp or pointed, as shown in FIG. 4E.

Figure 4F:
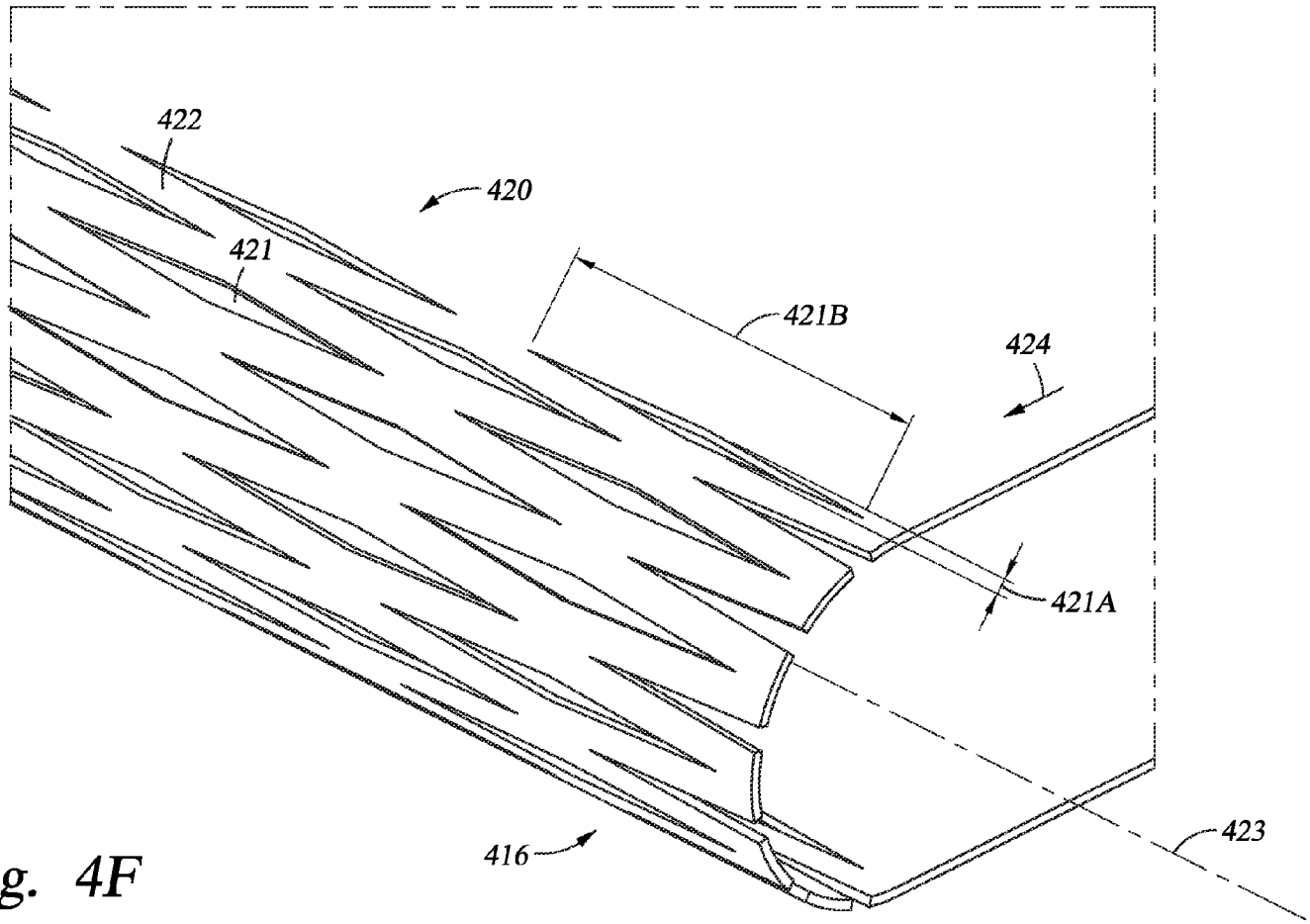

However, some electronic devices that are to be placed in the case 100 may have curved surfaces and round corners. In order to have the case 100 in the post assembled form conform to the surfaces of these types of electronic devices, the case 100 in the post assembled form may contain features that allow, or be processed to allow, the cover regions of the case 100 to bend, curve or flow with the curved surfaces of the electronic device. In one embodiment, the case 100 may be processed so that in its post assembled form the cover 100 includes scoring and/or cutting of the side cover regions 258, as shown in FIG. 4F. The scoring and/or cutting of the side cover regions 258 may be performed by one or more lasers or other similar technique. As a result of the scoring and cutting processes, side cover regions 416 may be formed. The side cover regions 416 may be formed so that portions of the cover 100 conform to the side surfaces of the covered electronic device. In some embodiments, the side cover region 416 may include a pattern 420 that is formed as a result of a scoring and/or cutting process. The pattern 420 may include a plurality of openings 421 and a plurality of connecting features 422. The connecting features 422 generally include the portions of the layers of the cover material that remains after adding the plurality of openings 421 to the cover. The plurality of openings 421 may include a regular, or even irregular, array of holes, slots or other shaped features that extend through at least a portion of the cover material. In one configuration, the openings 421 only extend through a single layer of a multilayered structure used to form the cover 100, such as, for example, layer 250, layer 252 or layer 254 illustrated in FIG. 2G. In other configurations, the openings 421 may extend through all of the layers of the cover 100, such as layers 220 and 230 (FIG. 2D) or layers 250-254 (FIG. 2G). In one example, the openings 421 are slot shaped features that have a width 421A and a length 421B, where the length 421B is generally larger than the width 421A. In some configurations, the width dimension 421A is aligned with the curved direction 424 (e.g., direction in which the tangent of the curve varies) and the length 421B dimension is aligned in a direction that is perpendicular with the curve direction (e.g., parallel to the axis 423 of the curve) at the edge of the electronic device. The corners 414 may be formed by one or more lasers so the corners 414 can be adapted to conform to the rounded edges of the electronic device.

Figure 4H:
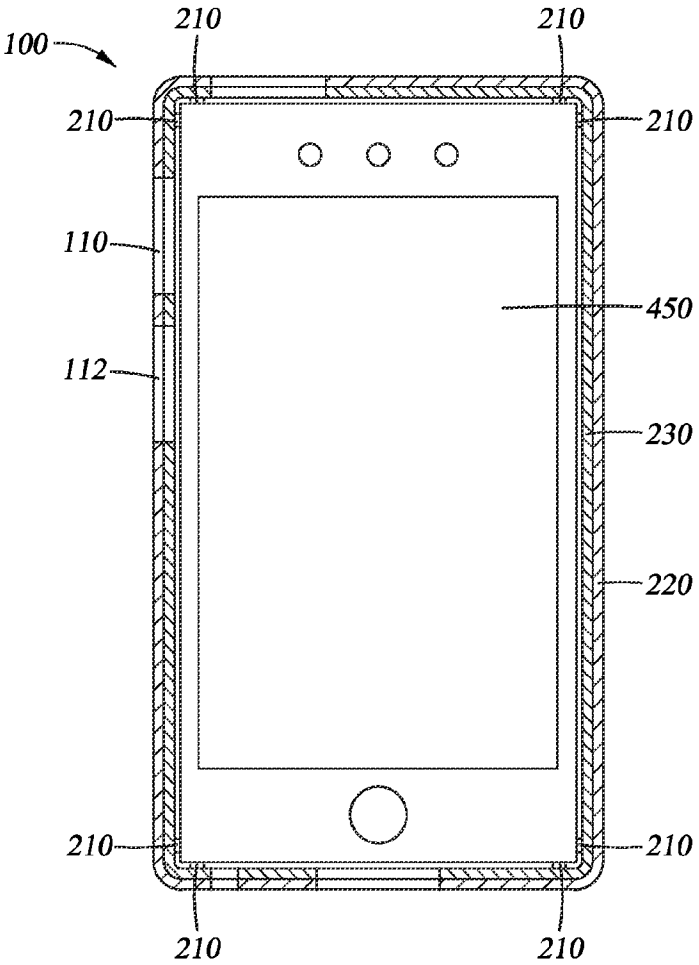
Figure 4G:
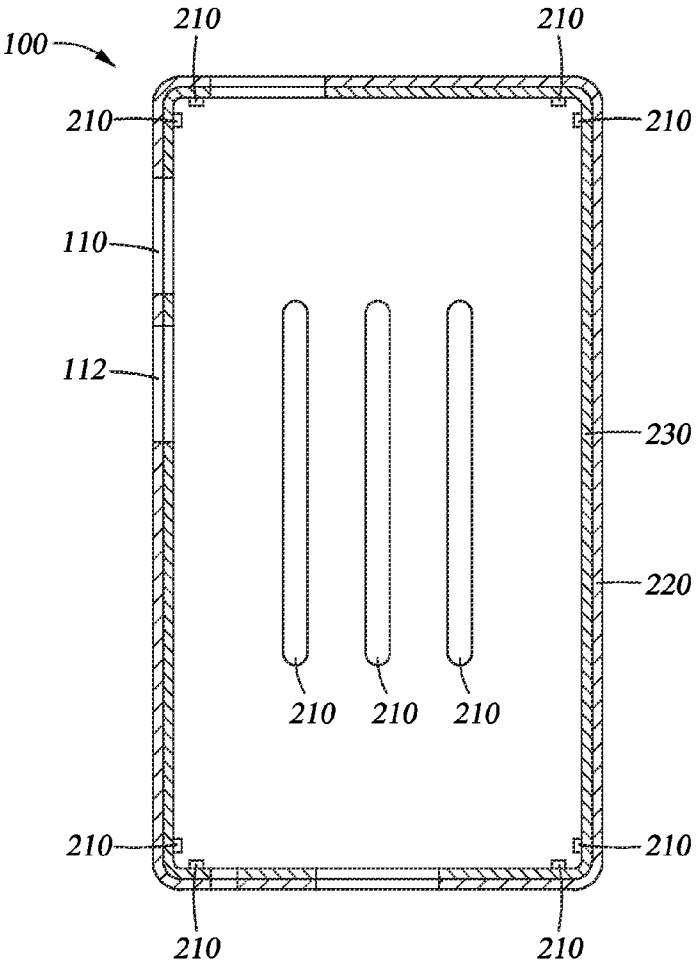

FIG. 4G is a cross sectional front view of the case 100 in post assembled form at section line 4G-4G shown in FIG. 4E. As shown in FIG. 4G, the case 100 includes the first layer 220 and the second layer 230 to increase the durability of the case 100. The plurality of protrusions 210 are formed on the case 100 to protect the electronic device placed in the case 100. FIG. 4H is a cross sectional front view of the case 100 in post assembled form having an electronic device 450 placed therein. As shown in FIG. 4H, the edges and the back of the electronic device 450 are in contacting with the plurality of protrusions 210. Thus, the energy transmitted to the electronic device 450 in an impact created when the case 100 and electronic device 450 are accidentally dropped or bumped is reduced by use of the plurality of protrusions 210.

Figure 5:
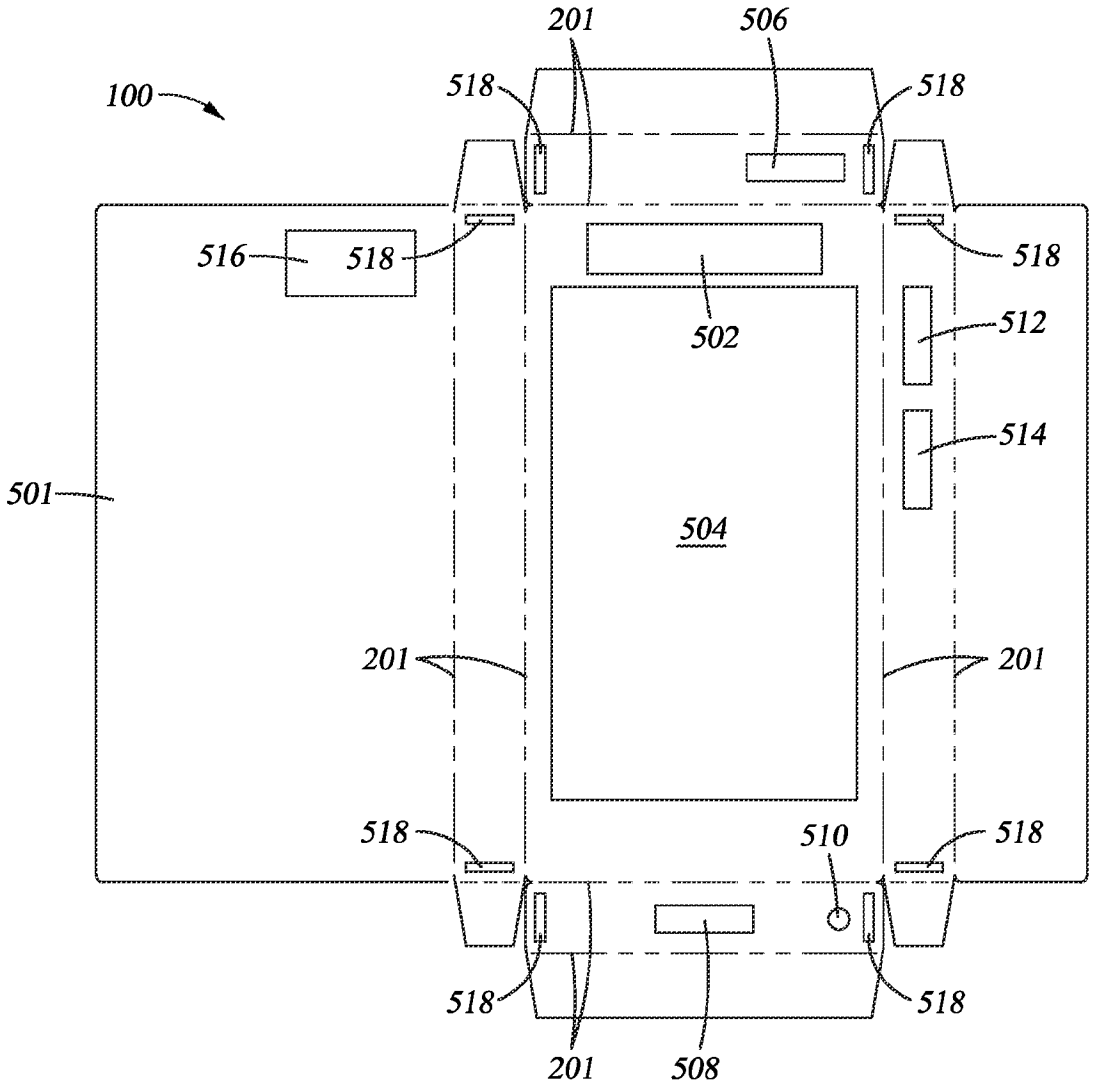
FIG. 5 is a conceptual diagram illustrates a case in preassembled form according to embodiments of the present disclosure.

FIG. 5 is a conceptual diagram illustrates the case 100 in preassembled form according to embodiments of the present disclosure. The case 100 in preassembled form may be formed of a planar medium 501. A first plurality of regions 502, 504, 506, 508, 510, 512, 514, 516 may be printed on the planar medium 501. The first plurality of regions 502, 504, 506, 508, 510, 512, 514, 516 may be configured to be easily removed from the planar medium 501. In one embodiment, the connection between each region 502, 504, 506, 508, 510, 512, 514, 516 and the planar medium 501 is perforated. Removal of the regions 502, 504, 506, 508, 510, 512, 514, 516 from the planar medium 501 forms the openings 106, 104, 122, 128, 126, 110, 112, 116 respectively, as shown in FIG. 2A. The regions formed on the planar medium 501 that are to be removed may depend on the type of the electronic device to be placed in the case 100.

A second plurality of regions 518 may be formed on the planar medium 501 of the case 100 in the preassembled form. The second plurality of regions 518 may be configured to protrude from the planar medium 501 when the case 100 is transformed in post assembled form. The protrusions formed by the second plurality of regions 518 may have the same functions as the protrusions 210 shown in FIG. 2A. A portion of each region 518 may be configured to be easily separated from the planar medium 501. In one embodiment, the connection between a portion of each region 518 and the planar medium 501 is perforated. A portion of each region 518 may be separated from the planar region, and the separated portion may be folded inwardly to form the protrusion. When an electronic device is placed in the case 100 in post assembled form, the electronic device is in contact with the protrusions, which can help reducing the impact to the electronic device when the electronic device is accidentally dropped or bumped. The planar medium 501 may also include the plurality of fold lines 201 formed thereon.

The preassembled form of the planar medium 501, as shown in FIG. 5, may be purchased by a consumer from a consumer products retailer. As noted above, the preassembled form of a planar medium 501 can be easily customized by either the consumer or by the retailer at the consumer's direction. Because the case 100, as shown in FIG. 5, is planar, it can be fed into a conventional printer or similar device (e.g., paper cutting printer) so that one or more aesthetic or functional aspects of the case 100 can be altered. In some embodiments, protective protrusions, which may be pre-formed in the planar medium 501 or added during the customization process, are used to protect portions of an electronic device (e.g., electronic device 450 in FIG. 4G). In one configuration, the protective protrusions are formed from portions of the planar medium 501 by separating a portion of each region 518 and folding the separated region inwardly, such as towards the inside of the case 100. Therefore, when the case 100 is disposed in its post assembled form, the formed protective protrusions will form protrusions that may have a similar form and function as the protrusions 210 illustrated in FIGS. 4F-4G. In other words, the material that is used to form the planar medium 501 can also be used to improve the protective nature of the case 100 by use of folded portions of the planar medium 501 that act as damage preventing and energy damping structural elements that are disposed between the case 100 and the electronic device.

A low cost customizable case for an electronic device is disclosed herein. The case may have a preassembled form which is substantially planar. The case in preassembled form may include a plurality of regions, and a plurality of protrusions may be formed on the plurality of regions that may cover the back, top, bottom and sides of the electronic device when the case is in the post assembled form. The protrusions are made of a material that absorbs the force of impact, so the electronic device placed in the case in post assembled form is protected.

The disclosure has been described above with reference to specific embodiments. Persons skilled in the art, however, will understand that various modifications and changes may be made thereto without departing from the broader spirit and scope of the disclosure as set forth in the appended claims. The foregoing description and drawings are, accordingly, to be regarded in an illustrative rather than a restrictive sense.

The invention claimed is:

1. A case for covering multiple sides of an electronic device, comprising:

a template having a first plurality of regions and a second plurality of regions, wherein the first plurality of regions include side cover regions, a top cover region, and a bottom cover region, and wherein the template is planar, a plurality of fold lines are disposed on the template, and the template is configured to be folded along the fold lines to form the case, and wherein the template comprises a first layer, a second layer, and a third layer; and a plurality of protrusions disposed on each of the first plurality of regions, wherein the protrusions are configured to be disposed between a portion of the template and the electronic device when the case is positioned to cover the multiple sides of the electronic device, and wherein the plurality of protrusions is formed on the first layer and the second layer is sandwiched between the first and third layers, and wherein the first layer comprises a shock absorbing material, the second layer comprises a tear resistant material, and the third layer comprises a surface that is printable and customizable.

2. A case for covering multiple sides of an electronic device, comprising:

a template having a first plurality of regions and a second plurality of regions, wherein the first plurality of regions include side cover regions, a top cover region, and a bottom cover region, and wherein the template is planar, a plurality of fold lines are disposed on the template, and the template is configured to be folded along the fold lines to form the case, and wherein the template comprises a first layer, a second layer, and a third layer; and a plurality of protrusions disposed on each of the first plurality of regions, wherein the protrusions are configured to be disposed between a portion of the template and the electronic device when the case is positioned to cover the multiple sides of the electronic device, and wherein the plurality of protrusions is formed on the first layer and the second layer is sandwiched between the first and third layers, and wherein the first layer comprises a tear resistant material, the second layer comprises a shock absorbing material, and the third layer comprises a surface that is printable and customizable.

3. A case for covering multiple sides of an electronic device, comprising:

a template having a first plurality of regions and a second plurality of regions, wherein the first plurality of regions include side cover regions, a top cover region, and a bottom cover region, and wherein the template is planar, a plurality of fold lines are disposed on the template, and the template is configured to be folded along the fold lines to form the case, and wherein the side cover regions each comprises an array of openings, wherein each of the openings comprises a slot that includes a length and a width, and wherein the lengths of the slots are aligned in a first direction, and are greater in magnitude than the width; and a plurality of protrusions disposed on each of the first plurality of regions, wherein the protrusions are configured to be disposed between a portion of the template and the electronic device when the case is positioned to cover the multiple sides of the electronic device.

4. The case of claim 3, wherein the plurality of protrusions comprise a polymer, rubber, or an elastomer.

5. The case of claim 3, wherein at least two of the first plurality of regions each further comprise at least a portion of an adhesion region.

6. The case of claim 5, wherein the first plurality of regions further includes a back cover region, and wherein the back cover region includes at least a portion of an interlocking mechanism.

7. The case of claim 3, wherein the template comprises a first layer and a second layer.

8. The case of claim 7, wherein the template further comprises a third layer, wherein the plurality of protrusions is formed on the first layer and the second layer is sandwiched between the first and third layers.

9. The case of claim 3, wherein the template comprises stone paper.

10. The case of claim 3, where in the second plurality of regions includes a front cover region, wherein at least one opening is formed in each of the front cover region, top cover region, and bottom cover region template.

11. A case for covering multiple sides of an electronic device, comprising:

a template having a first plurality of regions and a second plurality of regions, wherein the first plurality of regions include side cover regions, a top cover region, and a bottom cover region, wherein the side cover regions each comprises an array of openings, and wherein the template is planar, a plurality of fold lines are disposed on the template, and the template is configured to be folded along the fold lines to form the case; and a plurality of protrusions disposed on each of the first plurality of regions, wherein the protrusions are configured to be disposed between a portion of the template and the electronic device when the case is positioned to cover the multiple sides of the electronic device.

12. The case of claim 11, wherein the plurality of protrusions comprise a polymer, rubber, or an elastomer.

13. The case of claim 11, wherein at least two of the first plurality of regions each further comprises at least a portion of an adhesion region.

14. The case of claim 11, wherein the template comprises a first layer and a second layer.

15. The case of claim 11, wherein each of the openings of the array of openings of the side cover regions comprises a slot that includes a length and a width, and wherein the lengths of the slots are aligned in a first direction, and are greater in magnitude than the width.

16. The case of claim 11, wherein the template comprises stone paper.

17. The case of claim 11, where in the second plurality of regions includes a front cover region, wherein at least one opening is formed in each of the front cover region, top cover region, and bottom cover region.

18. The case of claim 11, wherein the plurality of protrusions comprises two protrusions disposed on opposite ends of each side cover region, two protrusions disposed on opposite ends of the top cover region, and two protrusions disposed on opposite ends of the bottom cover region.

19. The case of claim 18, wherein the plurality of protrusions are positioned to cover corners of the electronic device when the template is reconfigured to cover the multiple sides of the electronic device.

20. The case of claim 11, wherein the plurality of protrusions are positioned to cover corners of the electronic device when the template is reconfigured to cover the multiple sides of the electronic device.

21. A case for covering multiple sides of an electronic device, comprising:

a template having a first plurality of regions and a second plurality of regions, wherein the first plurality of regions include side cover regions, a top cover region, and a bottom cover region, wherein the side cover regions each comprises an array of openings, and wherein a plurality of fold lines are disposed on the template and the template is configured to be folded along the fold lines to form the case; and a plurality of protrusions disposed on each of the first plurality of regions, wherein the protrusions are configured to be disposed between a portion of the template and the electronic device when the case is positioned to cover the multiple sides of the electronic device.

22. The case of claim 21, wherein the plurality of protrusions comprise a polymer, rubber, or an elastomer.

23. The case of claim 21, wherein the template comprises a first layer and a second layer.

24. The case of claim 21, where in the second plurality of regions includes a front cover region, wherein at least one opening is formed in each of the front cover region, top cover region, and bottom cover region.

* * * * *